US006907761B2

(12) United States Patent
Spence et al.

(10) Patent No.: US 6,907,761 B2
(45) Date of Patent: Jun. 21, 2005

(54) METHOD AND APPARATUS FOR SUPERPLASTICALLY FORMING A WORKPIECE

(75) Inventors: Peter J Spence, Derby (GB); Richard G Milburn, Nottingham (GB)

(73) Assignee: Rolls-Royce plc, London (GB)

( * ) Notice: Subject to any disclaimer, the term of this patent is extended or adjusted under 35 U.S.C. 154(b) by 415 days.

(21) Appl. No.: 10/171,632

(22) Filed: Jun. 17, 2002

(65) Prior Publication Data

US 2003/0000275 A1 Jan. 2, 2003

(30) Foreign Application Priority Data

Jun. 30, 2001 (GB) ..... 0116061

(51) Int. Cl.[7] ..... B21D 26/02; B23K 26/08

(52) U.S. Cl. ..... 72/60; 72/56; 29/421.1

(58) Field of Search ..... 59/56, 57, 58, 59/59, 60, 61, 62; 29/421.1; 72/9, 10, 60, 342.94, 709, 342.1, 61, 37

(56) References Cited

U.S. PATENT DOCUMENTS

| | | | | |
|---|---|---|---|---|
| 4,181,000 A | * | 1/1980 | Hamilton et al. | 72/60 |
| 4,474,044 A | * | 10/1984 | Leistner et al. | 72/60 |
| 4,811,582 A | | 3/1989 | Story et al. | |
| 4,901,552 A | * | 2/1990 | Ginty et al. | 72/60 |
| 5,007,265 A | * | 4/1991 | Mahoney et al. | 72/37 |
| 5,277,045 A | * | 1/1994 | Mahoney et al. | 72/60 |
| 5,359,872 A | * | 11/1994 | Nashiki | 72/342.94 |
| 5,592,842 A | * | 1/1997 | Nyrhila | 72/60 |
| 5,737,954 A | * | 4/1998 | Yasui | 72/60 |
| 6,613,164 B2 | * | 9/2003 | Dykstra et al. | 72/342.96 |

FOREIGN PATENT DOCUMENTS

| | | |
|---|---|---|
| CH | 673603 AB | 3/1990 |
| EP | 0 703 019 A | 3/1996 |
| SU | 719753 AB | 3/1980 |
| SU | 721178 AB | 3/1980 |

* cited by examiner

*Primary Examiner*—David Jones
(74) *Attorney, Agent, or Firm*—W. Warren Taltavull; Manelli Denison & Selter PLLC

(57) ABSTRACT

A method of superplastically forming a workpiece comprises placing the workpiece (16) in a die (14) and heating the workpiece (16) to a temperature at which the workpiece (16) is superplastically formable. Pressure is applied to the workpiece (16) to superplastically form the workpiece (16) to the shape of the die (14). The temperature of the workpiece (16) is measured and is analysed to determine the measured temperature distribution of the workpiece (16) at stages in the superplastic forming process. A database of desired temperature distributions of the workpiece (16) at different stages in the superplastic forming process is kept. The measured temperature distribution of the workpiece (16) at each stage in the superplastic forming process is compared with the desired temperature distribution of the workpiece (16) at the stage in the superplastic forming process and heating means and/or cooling means (36, 38, 40, 46, 48, 58, 60, 66, 68, 94, 96) are controlled such that the temperature distribution of the workpiece (16) is adjusted to more closely match the desired temperature distribution of the workpiece (16) to control the thickness of the workpiece (16).

21 Claims, 3 Drawing Sheets

METHOD AND APPARATUS FOR SUPERPLASTICALLY FORMING A WORKPIECE

FIELD OF THE INVENTION

The present invention relates to a method and apparatus for superplastically forming a workpiece. The present invention relates in particular to a method and apparatus for superplastically forming a metal workpiece.

BACKGROUND OF THE INVENTION

It is known to superplastically form a workpiece by placing the workpiece in a die, within an autoclave, heating the die and workpiece up to a temperature at which the workpiece is superplastically formable and applying a pressure differential across the workpiece to superplastically form the workpiece to the shape of the die.

It is known from European patent application EP0703019A to superplastically form a workpiece using a laser to locally heat the workpiece up to a temperature at which the workpiece is superplastically formable and applying a pressure differential across the workpiece to superplastically form the workpiece to a required shape without the use of a die.

A problem with the above methods of superplastically forming a workpiece is that there is very little, or no, control of the thickness distribution of the resulting component or article.

SUMMARY OF THE INVENTION

Accordingly the present invention seeks to provide a novel method of superplastically forming a workpiece which reduces, preferably overcomes, the above mentioned problems.

Accordingly the present invention provides a method of superplastically forming a workpiece comprising placing the workpiece in a die, heating the whole of the workpiece up to a temperature at which the workpiece is superplastically formable, applying a pressure differential across the workpiece to superplastically form the workpiece to the shape of the die and heating and/or cooling the workpiece to provide a temperature distribution across the workpiece during the superplastic forming process to control the thickness of the workpiece.

Preferably the method comprises measuring the temperature of the workpiece and producing a temperature signal, analysing the temperature signal to determine the measured temperature distribution of the workpiece at least one stage in the superplastic forming process, maintaining a database of desired temperature distributions of the workpiece at different stages in the superplastic forming process, comparing the measured temperature distribution of the workpiece at the at least one stage in the superplastic forming process with the desired temperature distribution of the workpiece at the said stage in the superplastic forming process and controlling the heating means and/or the cooling means such that the temperature distribution of the workpiece is maintained at the desired temperature distribution of the workpiece or such that the temperature distribution of the workpiece is adjusted to more closely match the desired temperature distribution of the workpiece to control the thickness of the workpiece.

Preferably the method comprises heating the workpiece by directing at least one laser beam on the surface of the workpiece. Preferably the method comprises directing the at least one laser beam through at least one window in the die. Preferably the method comprises scanning the at least one laser beam across the surface of the workpiece.

Preferably the method comprises heating the workpiece by directing at least one infra red beam on the surface of the workpiece. Preferably the method comprises directing the at least one infra red beam through at least one window in the die. Preferably the method comprises scanning the at least one infra red beam across the surface of the workpiece.

Preferably the method comprises cooling the workpiece by directing a cooling inert gas on the surface of the workpiece.

The method may comprise heating and cooling the workpiece over a predetermined temperature range such that the workpiece is superplastically formed by phase transformation superplasticity.

Preferably the method comprises heating and/or cooling both sides of the workpiece.

Preferably the method comprises measuring the temperature of the workpiece by viewing the workpiece with a thermographic camera.

The present invention also seeks to provide a novel apparatus for superplastically forming a workpiece which reduces, preferably overcomes, the above mentioned problems.

The present invention also provides an apparatus for superplastically forming a workpiece comprising a die, heating means to heat the workpiece, cooling means to cool the workpiece, means to apply a pressure differential across the workpiece to superplastically form the workpiece to the shape of the die and processor means arranged to control the heating and/or cooling of the workpiece to provide a temperature distribution across the workpiece during the superplastic forming process to control the thickness of the workpiece.

Preferably the apparatus comprises means to measure the temperature of the workpiece and to produce a temperature signal, a processor arranged to analyse the temperature signal to determine the measured temperature distribution of the workpiece at at least one stage in the superplastic forming process, a database of desired temperature distributions of the workpiece at different stages in the superplastic forming process, the processor being arranged to compare the measured temperature distribution of the workpiece at the at least one stage in the superplastic forming process with the desired temperature distribution of the workpiece at the said stage in the superplastic forming process, the processor being arranged to control the heating means and/or the cooling means such that the measured temperature distribution of the workpiece is maintained at the desired temperature distribution of the workpiece or such that the temperature distribution of the workpiece is adjusted to more closely match the desired temperature distribution of the workpiece to control the thickness of the workpiece.

Preferably the heating means comprises at least one laser gun arranged to direct a laser beam on the surface of the workpiece. Preferably the die comprises at least one window and the laser gun is arranged to direct the at least one laser beam through at least one window in the die. Preferably there are means to scan the at least one laser beam across the surface of the workpiece.

Preferably the heating means comprises at least one infra red lamp arranged to direct at least one infra red beam on the surface of the workpiece. Preferably the die comprises at least one window and the infra red lamp is arranged to direct the at least one infra red beam through at least one window in the die. Preferably there are means to scan the at least one infra red beam across the surface of the workpiece.

Preferably the cooling means comprises means to direct a cooling inert gas on the surface of the workpiece.

Preferably the heating and/or cooling means are arranged on both sides of the workpiece.

Preferably the means to measure the temperature of the workpiece comprises a thermographic camera.

BRIEF DESCRIPTION OF THE DRAWINGS

The present invention will be more fully described by way of example with reference to the accompanying drawings in which.

DETAILED DESCRIPTION OF THE INVENTION

Figure 1:
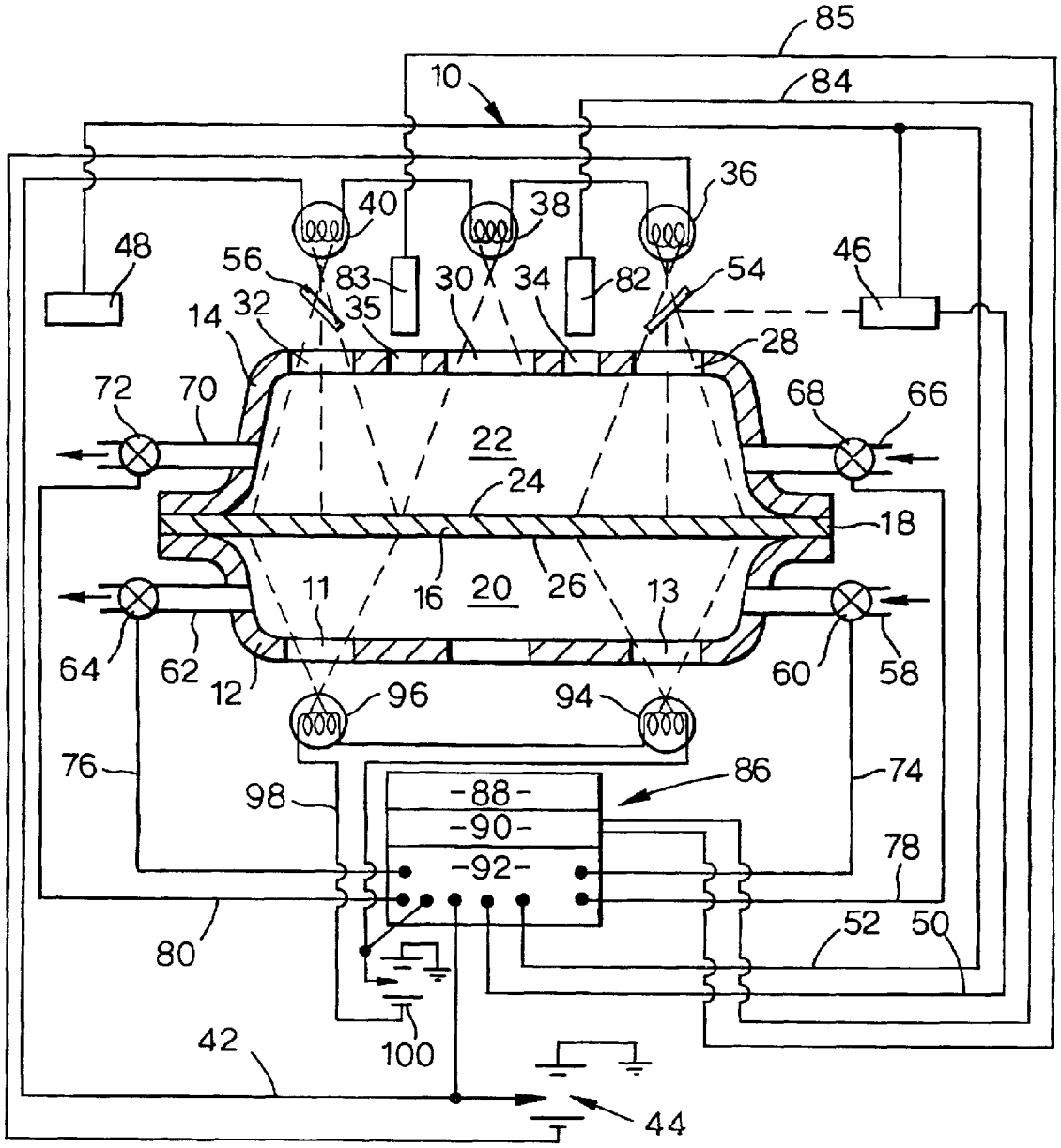
FIG. 1 shows an apparatus for superplastically forming a workpiece according to the present invention.

An apparatus 10 for superplastically forming a workpiece 16 is shown in FIG. 1. The apparatus 10 comprises a back plate 12 and a die 14 which are arranged to clamp the periphery 18 of the workpiece 16 to form sealed chambers 20 and 22 with the back plate 12 and the die 14 respectively.

The back plate 12 comprises at least one window, in this example two windows 11 and 13 to allow radiant heating beams to impinge upon the surface 26 of the workpiece 16.

The die 14 comprises at least one window, in this example three windows 28, 30 and 32 to allow radiant heating beams to impinge upon the surface 24 of the workpiece 16. The die 14 has one or more further windows 34 and 35 to allow radiant heat from the surface 24 of the workpiece 16 to leave the die 14.

At least one infra red lamp, in this example three infra red lamps 36, 38 and 40 are provided to direct infra red beams through the windows 28, 30 and 32 respectively onto the surface 24 of the workpiece 16. The infra red lamps 36, 38 and 40 are supplied with electrical power from a source of electrical energy 42 via electrical leads 44. The infra red lamps 36, 38 and 40 are arranged to provide a broad, defocused, beams to heat large areas of the surface 24 of the workpiece 16.

At least one laser gun, in this example two laser guns 46 and 48 are provided to direct laser beams through the windows 28 and 32 respectively onto the surface 24 of the workpiece 16. The laser guns 46 and 48 are arranged to provide narrow, focused, beams to heat small areas of the surface 24 of the workpiece 16. In this example mirrors 54 and 56 are provided to direct the laser beams from the laser guns 46 and 48 respectively through the windows 28 and 32 respectively. The mirrors 54 and 56 are gimballed to allow the mirrors 54 and 56 to rotate about two perpendicular axes. The mirrors 54 and 56 allow the laser beams to be scanned across the surface 24 of the workpiece 16. The mirrors 54 and 56 may be moved by galvanometers.

At least one infra red lamp, in this example two infra red lamps 94 and 96 are provided to direct radiant heat through the windows 11 and 13 heat onto the surface 26 of the workpiece 16. The infra red lamps 94 and 96 are supplied with electrical power from a source of electrical energy 100 via electrical leads 98. The infra red lamps 94 and 96 are arranged to provide a broad, defocused, beams to heat large areas of the surface 26 of the workpiece 16.

An inlet pipe 58 and valve 60 allow the supply of inert gas, for example argon, into the chamber 20 defined between the back plate 12 and the workpiece 16 and an outlet pipe 62 and valve 64 allow the removal of the inert gas from the chamber 20. An inlet pipe 66 and valve 68 allow the supply of inert gas, for example argon, into the chamber 22 defined between the die 14 and the workpiece 16 and an outlet pipe 70 and valve 72 allow the removal of the inert gas from the chamber 22.

A greater pressure of inert gas is supplied to the chamber 20 than the chamber 22 to cause the workpiece 16 to be superplastically formed to the shape of the die 14.

On or more thermographic, thermal, cameras 82 and 83 are arranged to view the surface 24 of the workpiece 16 through the windows 34 and 35. The thermographic cameras 82 and 83 send temperature signals to the processor 86 via electrical leads 84 and 85.

The processor 86 is arranged to control the superplastic forming process. The processor 86 comprises a database 88, or model, of the temperature distribution of the workpiece 16 at different stages of the superplastic forming process. Each desired temperature distribution of the workpiece 16 stored in the database 88 of the processor 86 has a desired temperature gradient across the workpiece 16. The temperature gradient controls the thickness of the resulting component or article. The processor 86 comprises an analyser 90, which analyses the temperature signals produced by the thermal cameras 82 and 83 to determine the measured temperature distribution of the workpiece 16 sequentially at each stage in the superplastic forming process. The processor 86 comprises a comparator 92, which sequentially compares the measured temperature distribution of the workpiece at each stage in the superplastic forming process with the desired temperature distribution of the workpiece 16 stored in the database 88 at the corresponding stage in the superplastic forming process.

The processor 86 is arranged to control the heating of the surface 24 of the workpiece 16 provided by the infra red lamps 36, 38 and 40 by controlling the amount of electrical energy supplied by the source of electrical energy 44.

The processor 86 is arranged to control the heating of the surface 24 of the workpiece 16 provided by the laser guns 46 and 48 via electrical leads 50 and 52 respectively.

The processor 86 is arranged to control the heating of the surface 26 of the workpiece 16 provided by the radiant heaters 94 and 96 by controlling the amount of electrical energy supplied by the source of electrical energy 100.

The processor 86 is arranged to control the supply of inert gas into and out of the chamber 20 by adjusting the valves 60 and 64 via the electrical leads 74 and 76 respectively. The processor 86 is arranged to control the supply of inert gas into and out of the chamber 22 by adjusting the valves 68 and 72 via the electrical leads 78 and 80 respectively.

In operation the periphery 18 of a workpiece 16 of the desired material, for example a titanium alloy 6 wt % Al, 4 wt % V and the balance Ti, is clamped between the back plate 12 and the die 14.

The processor 86 allows the infra red lamps 94 and 96 and the infra red lamps 36, 38 and 40 to heat the whole of the workpiece 16 up to a temperature at which the workpiece 16 is capable of superplastic deformation. In the case of the above mentioned titanium alloy, Ti 6Al 4V, the temperature is at least 760° C., preferably at least 850° C.

During the superplastic forming process the at least one thermographic camera 82 and 83 sequentially supply temperature signals indicating the temperature at all points on the surface 24 of the workpiece 16 at different stages in the superplastic forming process to the processor 86. The analyser 90 of the processor 86 sequentially analyses the temperature signals to determine the measured temperature distribution of the workpiece 16 at the different stages in the superplastic forming process. The analyser 90 preferably analyses the temperature signals to determine the temperature distribution in three dimensions. Either there are two cameras 82 and 83 to provide a stereoscopic view of the surface 24 of the workpiece 16 or a single camera has a split field of view. The comparator 92 of the processor 86 sequentially compares the measured temperature distribution of the workpiece 16 at each stage in the superplastic forming process with the desired temperature distribution of the workpiece 16, stored in the database 88, at the corresponding stage in the superplastic forming process.

If the comparator 92 determines that the measured temperature distribution of the workpiece 16 differs from the desired temperature distribution of the workpiece 16 at a particular stage in the superplastic forming process, then the processor 86 sends signals to control the amount of heating provided by the infra red lamps 36, 38 and 40, the infra red lamps 94 and 96 and the laser guns 46 and 48 and sends signal to the valves 60, 64, 68 and 70 to control the amount of cooling provided by the inert gas flowing through the chambers 20 and 22.

The processor 86 opens, or closes, the valves 60, 64, 68 and 72 to increase, or decrease, the flow of cooling inert gas to maintain the minimum temperature of the workpiece 16 at the temperature required for superplastic forming. In addition the processor 86 allows selected ones of the infra red lamps 36, 38 and 40 and infra red lamps 94 and 96 to direct infra red radiation over large regions of the workpiece 16, which were at a temperature below the desired temperature. These large regions are those regions in which the temperature energy deficit multiplied by the area is the largest. The processor 86 allows the laser guns 46 and 48 to direct the laser beams at small regions of the workpiece 16, which have a relatively high temperature gradient.

The processor 86 also controls the valves 60, 64, 68 and 72 such that there is pressure difference between the chambers 20 and 22 to superplastically form the workpiece 16 to the shape of the die 14.

The heating intensity may be reduced towards the end of the superplastic forming process and the pressure of the inert gas in the chamber 20 is increased to force the workpiece 16 into the corners of the die 14 to reduce the processing time and save energy and costs.

Figure 2:
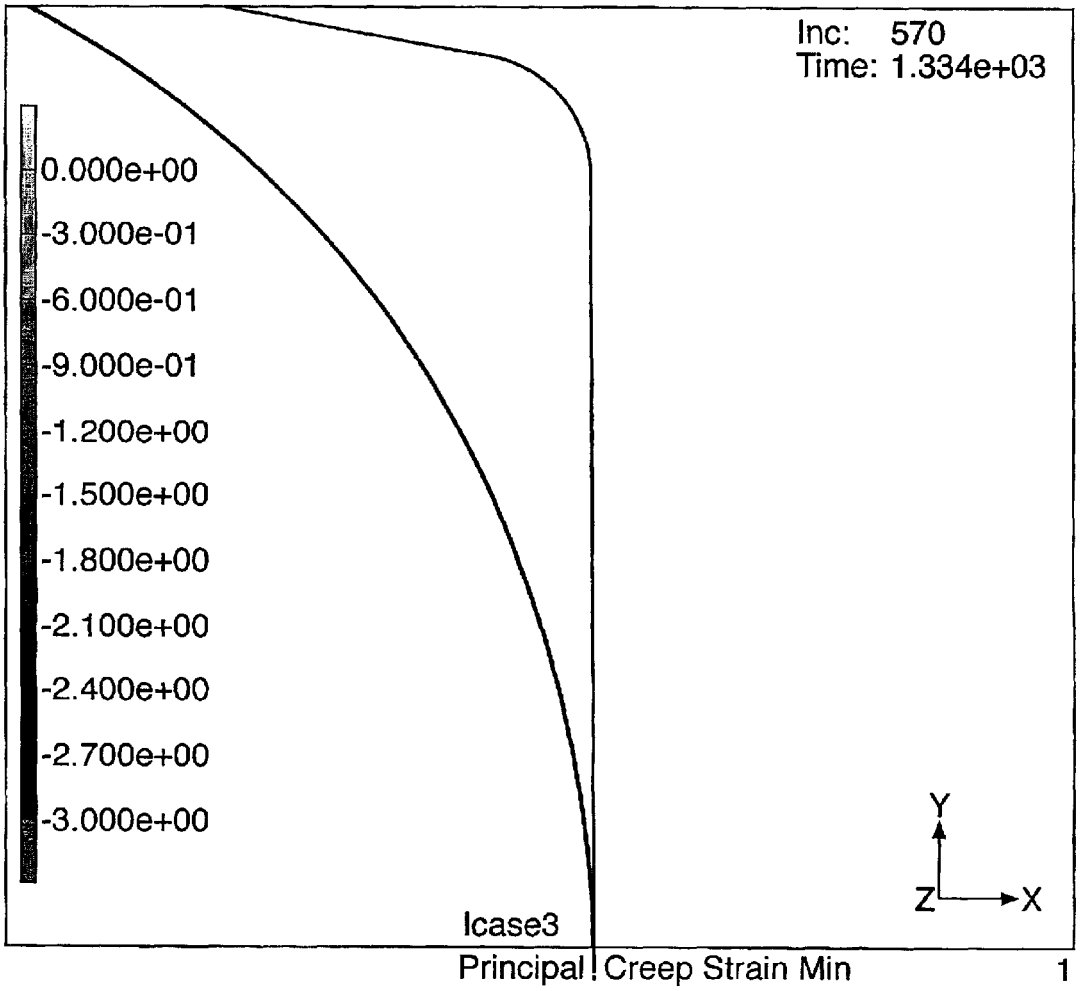
FIG. 2 is graph showing thinning of an axis-symmetric workpiece during superplastic forming using a constant temperature.

FIG. 2 shows the thickness distribution of an axis-symmetric workpiece 16 during conventional superplastic forming. During conventional superplastic forming the workpiece 16 is superplastically formed with a constant temperature across the workpiece 16. It is clear that the workpiece 16 and thus the resulting component, or article, is thicker at its periphery with a gradual reduction in thickness to a minimum thickness at the centre of the workpiece 16.

Figure 3:
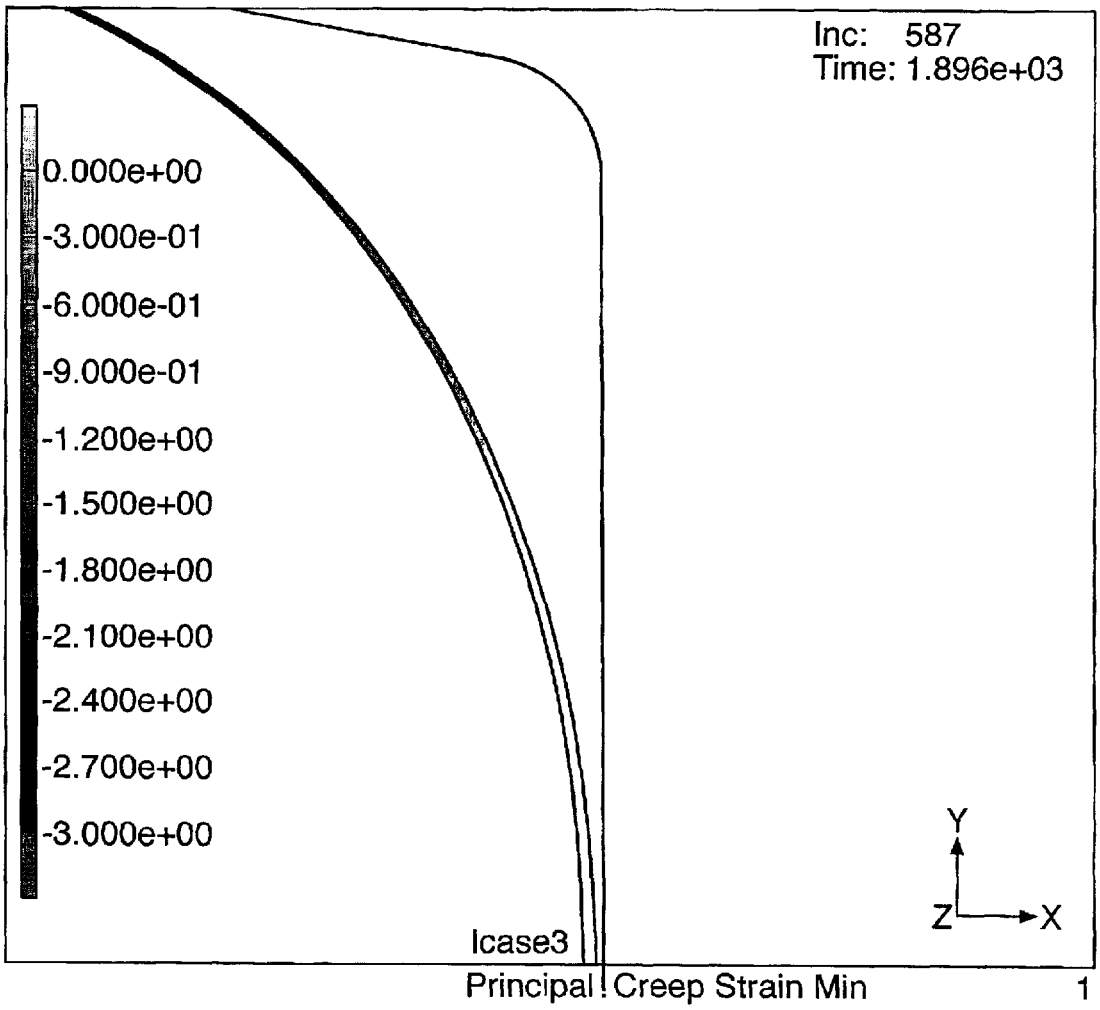
FIG. 3 is graph showing thinning of an axis-symmetric workpiece during superplastic forming using a temperature gradient.

FIG. 3 shows the thickness distribution of an axis-symmetric workpiece 16 during superplastic forming according to the present invention. During superplastic forming according to the present invention the workpiece 16 is superplastically formed with a temperature gradient applied across the workpiece 16. It is clear that in this example the workpiece 16 and thus the resulting component, or article, has a more uniform thickness and reduced thinning.

As an example of the present invention the superplastic forming of an axis-symmetric workpiece is described. A temperature gradient is provided between the periphery 18 of the workpiece and the centre of the workpiece 16. In particular the periphery 18 of the workpiece 16 is heated to a higher temperature than the centre of the workpiece 16, such that the thinning of the centre of the workpiece 16 is reduced.

The advantages of the invention are that the thinning, thickness, or strain distribution of the workpiece 16 may be precisely controlled, by controlling the heating and/or cooling of different regions of the workpiece 16. This advantage enables thinner, and hence lower cost, workpieces to be used because the workpiece is thinned only in the required regions and in a more uniform manner within those regions. Alternatively, by making the deformation more uniform, and hence reducing the peak strain, greater mean strain rates may be applied to the workpiece 16, leading to a reduction in manufacturing time and costs. In addition the localised heating of the workpiece 16 by the infra red beams and laser beams means that the back plate and die are not heated and therefore the back plate and die are lower cost and easier to manufacture.

In a further embodiment of the present invention the laser guns 46 and 48 are scanned across the surface 24 of the workpiece 16 such that the temperature of the workpiece 16 at each point on the surface 24 is allowed to oscillate over a predetermined temperature range. Additionally, the inert gas may be directed against the surfaces 24 and 26 of the workpiece 16 to increase the cooling rate to increase the oscillation rate. The oscillation of the temperature over the predetermined temperature range causes phase transformation superplasticity to occur in the workpiece 16. The predetermined temperature range is arranged to extend to a temperature greater than a phase transformation temperature of the workpiece 16 and to a temperature less than the phase transformation temperature of the workpiece 16. In phase transformation superplasticity the relative amounts of the different phases in an alloy changes to allow superplastic deformation to occur under conditions of constant load. This enables a small amount of superplastic deformation to occur at each temperature cycle. The phase transformation superplasticity enables materials, which do not exhibit superplasticity to be superplastically formed, for example welded metals, welded alloys, coarse grain metals or alloys or metal matrix composites. The rate of deformation of the workpiece 16 may be constrained by the rate at which the workpiece 16 may be cycled. The response time for the workpiece 16 is proportional to the square of the thickness of the workpiece 16. The response time for the workpiece 16 depends upon the heat transfer coefficient and the temperature of the inert gas. Thus heating and cooling both surfaces 24 and 26 of the workpiece 16 increases the rate at which the workpiece 16 may be cycled.

The titanium alloy consisting of 6 wt % Al, 4 wt % V and the balance Ti, comprises alpha and beta phases below a temperature of about 950° C. and comprises only beta phase above a temperature of about 950° C. For the titanium alloy consisting of 6 wt % Al, 4 wt % V and the balance Ti, the temperature may be cycled between 760° C. and 980° C. or between 880° C. and 1020° C. to obtain the phase transformation superplasticity, or between other suitable temperatures one of which is above and one of which is below the phase transformation temperature.

For a 1 mm thick workpiece of titanium alloy 6 wt % Al, 4 wt % V and the balance Ti, the heating time is 0.33 seconds for single surface heating and 0.1 second for double surface heating.

The present invention has been described with reference to mirrors to direct the laser beam onto the workpiece, but it may be equally possible to arrange each laser gun in a carriage and to move the carriage in two mutually perpendicular directions. Alternatively, each laser beam may be directed using an optical fibre.

Although the present invention has been described with reference to laser guns directing laser beams on only one surface of the workpiece it is equally possible to arrange for laser guns to direct laser beams on both surfaces of the workpiece.

Any suitable number of laser guns may be provided.

Any suitable number of infra red lamps may be provided.

Although the present invention has been described with reference to laser guns and infra red lamps heating the workpiece, other suitable heaters may be provided to heat the workpiece without heating the die and/or back plate.

The present invention is applicable to the superplastic forming of aluminium, aluminium alloys, magnesium, magnesium alloys, lead/tin alloys, iron alloys, nickel alloys for example IN718, metal matrix composite material, either fibre reinforced or particle reinforced, and ceramics.

We claim:

1. A method of superplastically forming a workpiece comprising placing the workpiece having a thickness and a surface in a die having a shape, heating the whole of the workpiece up to a temperature at which the workpiece is superplastically formable, applying a pressure differential across the workpiece to superplastically form the workpiece to the shape of the die and heating and/or cooling the workpiece to provide a temperature distribution across the workpiece during the superplastic forming process to control the thickness of the workpiece, the method further comprising measuring the temperature of the workpiece and producing a temperature signal, analysing the temperature signal to determine the measured temperature distribution of the workpiece at at least one stage in the superplastic forming process, maintaining a database of desired temperature distributions of the workpiece at different stages in the superplastic forming process, comparing the measured temperature distribution of the workpiece at the at least one stage in the superplastic forming process with the desired temperature distribution of the workpiece at the said stage in the superplastic forming process and controlling the heating and/or the cooling such that the temperature distribution of the workpiece is maintained at the desired temperature distribution of the workpiece or such that the temperature distribution of the workpiece is adjusted to more closely match the desired temperature distribution of the workpiece to control the thickness of the workpiece.

2. A method as claimed in claim 1, comprising heating the workpiece by directing at least one infra red beam on the surface of the workpiece.

3. A method as claimed in claim 2 comprising directing the at least one infra red beam through at least one window in the die.

4. A method as claimed in claim 2 comprising scanning the at least one infra red beam across the surface of the workpiece.

5. A method as claimed in claim 1 comprising cooling the workpiece by directing a cooling inert gas on the surface of the workpiece.

6. A method as claimed in claim 1 comprising heating and cooling the workpiece over a predetermined temperature range such that the workpiece is superplastically formed by phase transformation superplasticity.

7. A method as claimed in claim 1 wherein said workpiece has opposite sides and comprising heating and/or cooling both said sides of the workpiece.

8. A method as claimed in claim 1 comprising measuring the temperature distribution of the workpiece by viewing the workpiece with a thermographic camera.

9. A method of superplastically forming a workpiece having a thickness and a surface comprising placing the workpiece in a die having a shape, heating the whole of the workpiece up to a temperature at which the workpiece is superplastically formable, applying a pressure differential across the workpiece to superplastically form the workpiece to the shape of the die and heating and/or cooling the workpiece to provide a temperature distribution across the workpiece during the superplastic forming process to control the thickness of the workpiece and comprising heating the workpiece by directing at least one laser beam on the surface of the workpiece.

10. A method as claimed in claim 9 comprising directing the at least one laser beam through at least one window in the die.

11. A method as claimed in claim 9 comprising scanning the at least one laser beam across the surface of the workpiece.

12. An apparatus for superplastically forming a workpiece having a thickness and a surface, comprising a die having a shape, heating means to heat the workpiece, cooling means to cool the workpiece, means to apply a pressure differential across the workpiece to superplastically form the workpiece to the shape of the die and processor means arranged to control the heating and/or cooling of the workpiece to provide a temperature distribution across the workpiece during the superplastic forming process to control the thickness of the workpiece and comprising means to measure the temperature of the workpiece and to produce a temperature signal, a processor arranged to analyse the temperature signal to determine the measured temperature distribution of the workpiece at at least one stage in the superplastic forming process, a database of desired temperature distributions of the workpiece at different stages in the superplastic forming process, the processor being arranged to compare the measured temperature distribution of the workpiece at the at least one stage in the superplastic forming process with the desired temperature distribution of the workpiece at the said stage in the superplastic forming process, the processor being arranged to control the heating means and the cooling means such that the measured temperature distribution of the workpiece is maintained at the desired temperature distribution of the workpiece or such that the temperature distribution of the workpiece is adjusted to more closely match the desired temperature distribution of the workpiece to control the thickness of the workpiece.

13. An apparatus as claimed in claim 12, wherein the heating means comprises at least one infra red lamp arranged to direct at least one infra red beam on the surface of the workpiece.

14. An apparatus as claimed in claim 13 wherein the die comprises at least one window and the infra red lamp is arranged to direct the at least one infra red beam through at least one window in the die.

15. An apparatus as claimed in claim 13 comprising means to scan the at least one infra red beam across the surface of the workpiece.

16. An apparatus as claimed in claim 12 wherein the cooling means comprises means to direct a cooling inert gas on the surface of the workpiece.

17. An apparatus as claimed in claim 12 wherein the workpiece has two sides and the heating and/or cooling means are arranged on both sides of the workpiece.

18. An apparatus as claimed in claim 12 wherein the means to measure the temperature of the workpiece comprises a thermographic camera.

19. An apparatus for superplastically forming a workpiece having a thickness and a surface, comprising a die having a shape, heating means to heat the workpiece, cooling means to cool the workpiece, means to apply a pressure differential across the workpiece to superplastically form the workplace to the shape of the die and processor means arranged to control the heating and/or cooling of the workpiece to provide a temperature distribution across the workpiece during the superplastic forming process to control the thickness of the workpiece wherein the heating means comprises at least one laser gun arranged to direct a laser beam on the surface of the workpiece.

20. An apparatus as claimed in claim 19 wherein the die comprises at least one window and the laser gun is arranged to direct the at least one laser beam through at least one window in the die.

21. An apparatus as claimed in claim 19 comprising means to scan the at least one laser beam across the surface of the workpiece.

* * * * *